US010484802B2

(12) United States Patent
Fritsch

(10) Patent No.: US 10,484,802 B2
(45) Date of Patent: Nov. 19, 2019

(54) HEARING AID FOR PEOPLE HAVING ASYMMETRIC HEARING LOSS

(71) Applicant: Domestic Legacy Limited Partnership, Indianapolis, IN (US)

(72) Inventor: Michael H Fritsch, Indianapolis, IN (US)

(73) Assignee: Domestic Legacy Limited Partnership, Indianapolis, IN (US)

( * ) Notice: Subject to any disclaimer, the term of this patent is extended or adjusted under 35 U.S.C. 154(b) by 0 days.

(21) Appl. No.: 15/268,555

(22) Filed: Sep. 17, 2016

(65) Prior Publication Data

US 2017/0085998 A1 Mar. 23, 2017

Related U.S. Application Data

(60) Provisional application No. 62/220,205, filed on Sep. 17, 2015.

(51) Int. Cl.
*H04R 25/00* (2006.01)

(52) U.S. Cl.
CPC ..... *H04R 25/505* (2013.01); *H04R 25/353* (2013.01); *H04R 25/40* (2013.01); *H04R 25/554* (2013.01); *H04R 2430/01* (2013.01); *H04R 2460/13* (2013.01)

(58) Field of Classification Search
CPC ..... H04R 25/00; H04R 25/55; H04R 25/558; H04R 2225/49; H04R 2460/01
USPC ..... 381/312–313, 315–317
See application file for complete search history.

(56) References Cited

U.S. PATENT DOCUMENTS 5,029,216 A * 7/1991 Jhabvala ..... G02C 11/06 381/313
5,991,419 A * 11/1999 Brander ..... H04R 25/552 381/312
6,549,633 B1 * 4/2003 Westermann ..... H04R 25/453 381/312
7,650,194 B2 1/2010 Fritsch et al.
7,953,237 B2 * 5/2011 Sporer ..... H04R 25/453 381/312
8,121,321 B2 * 2/2012 Iwano ..... H04R 25/43 381/312
8,208,642 B2 * 6/2012 Edwards ..... H04R 25/552 381/23.1

(Continued)

OTHER PUBLICATIONS

University of Maryland Medical Center, Hearing and Balance Center, Bone Anchored Devices.

(Continued)

*Primary Examiner* — Suhan Ni
(74) *Attorney, Agent, or Firm* — Indiano Law Group, LLC; E. Victor Indiano; John T. Woods

(57) ABSTRACT

The hearing aid apparatus includes a first hearing aid member and a second hearing aid member. The first hearing aid member is placeable on a patient's body, and includes a first transducer for receiving sounds that would be received by the patient's first ear and converting these received sounds into first transmittable signals. The second hearing aid is placeable on a patient's body adjacent to the patient's second ear, and includes a receiver for receiving the first transmittable electrical signals and a second transducer for converting the first transmittable electrical signals into sound signals configured for delivery to the patient's second ear.

14 Claims, 4 Drawing Sheets

(56) References Cited

U.S. PATENT DOCUMENTS

| | | | | |
|---|---|---|---|---|
| 8,805,546 | B2 | 12/2014 | Fritsch et al. | |
| 8,909,348 | B2 | 12/2014 | Fritsch et al. | |
| 2006/0093172 | A1* | 5/2006 | Ludvigsen | H04R 25/552 381/315 |
| 2006/0198529 | A1* | 9/2006 | Kjems | H04R 25/407 381/26 |
| 2007/0005117 | A1 | 1/2007 | Fritsch et al. | |
| 2007/0149261 | A1* | 6/2007 | Huddart | H04R 5/033 455/575.2 |
| 2007/0225776 | A1 | 9/2007 | Fritsch et al. | |
| 2008/0045859 | A1 | 2/2008 | Fritsch et al. | |
| 2008/0273727 | A1* | 11/2008 | Hagen | H04R 25/407 381/313 |
| 2011/0130696 | A1 | 6/2011 | Fritsch et al. | |
| 2011/0245891 | A1 | 10/2011 | Fritsch et al. | |
| 2011/0257571 | A1 | 10/2011 | Fritsch et al. | |
| 2014/0012282 | A1 | 1/2014 | Fritsch | |
| 2016/0262937 | A1 | 9/2016 | Fritsch | |

OTHER PUBLICATIONS

European Archives of Oto-Rhino-Laryngology; Pilot Study on the Effectiveness of the conventional CROS, the transcranial CROS and the BAHA transcranial CROS in adults with unilateral inner ear deafness; Myrthe K. S. Hol, Sylvia J, W. Kunst, AD F. M. Snik and COR W.R.J.Cremers; Sep. 15, 2016.

Wikipedia; Cross Hearing Aid; Jul. 18, 2016 (Internet reprint).

Michael Valente, Maureen Valente, and Karen Mispagel, Fitting Options for Adult Patients with Single Sided Deafness (SSD), Audiology Online, http://www.audiologyonline.com/articles/fitting-options-for-adult-patients-980, Aug. 14, 2006.

* cited by examiner

HEARING AID FOR PEOPLE HAVING ASYMMETRIC HEARING LOSS

BENEFIT OF PRIORITY

The instant application claims benefit of priority to Michael H. Fritsch, U.S. Provisional Patent Application No. 62/220,285 that was filed on 17 Sep. 2015 for a HEARING AID FOR PEOPLE HAVING ASYMMETRIC HEARING LOSS, which patent application is incorporated by reference herein in its entirety.

I. TECHNICAL FIELD OF THE INVENTION

The present invention relates to hearing aids, and more particularly, to a hearing aid that is especially useful for people with an asymmetric hearing loss.

II. BACKGROUND OF THE INVENTION

Hearing loss is not uncommon in persons, who are either born with a hearing loss or who develop a hearing loss later in life. When a hearing loss develops, the hearing loss is not always equal bilaterally. In particular, it is not unusual that one ear will have less hearing loss than the other, and therefore have better auditory acuity than the relatively more hearing impaired other ear. For example, someone may have a 70% hearing loss in their left ear, but only a 30% hearing loss in their right ear.

Also, unusual cases exist where a tumor has destroyed or damaged one ear, although the person has an undamaged, normal opposite ear which results in an asymmetric auditory acuity between the two ears. In certain instances, the hearing loss in one ear can be very profound, so that the person for example, has an auditory acuity in a bad ear that may be only 10% to 20% of the auditory acuity of a "normal ear."

For the sake of consistency, the application will assume that the patient's first or left ear is her "bad" ear and that the person's second right ear is her "good" ear. It will be appreciated that the choice of "first and left" for the bad ear is and "right and second" for the good ear is a purely arbitrary convention, and is not to be taken as any sort of limitation. It will also be noted that as used herein, a "good" ear is one with a greater auditory acuity than the "bad" ear, and that "good" and "bad" are relative and comparative terms, and not absolutes. It will further be appreciated that the difference between the auditory acuity of the good ear and the bad ear is highly variable between a condition where the difference in auditory acuity between the two ears is unnoticeable to the user; and an opposite extreme where the good ear has normal or above normal auditory acuity, and the bad ear has no auditory acuity. Normally an asymmetric hearing loss is treated when a person obtains hearing aids, and the asymmetric hearing loss is diagnosed by the practitioner.

The usual manner in which an asymmetric hearing loss is treated is to place a hearing aid in each of the ears. Often, the hearing aid placed in the "bad" ear can be adjusted so that it amplifies the sound to a greater degree than the hearing aid placed in the "good" ear. Unfortunately, some hearing losses are so profound that a normal or approximately symmetric hearing condition cannot be restored even with an amplification adjusted hearing aid. For example, even with a hearing aid, a patient may have an effective hearing acuity of only thirty percent (30%) in his bad ear whereas his good ear has a corrected hearing ability to within normal limits.

Patients experience difficulty with hearing in such cases where the ears cannot be corrected equally to provide symmetric hearing. In particular, a patient often will hear accurate, clear sound information out of her good ear, but garbled information out of her bad ear. This combination of garbled and clear sound information becomes very distracting to the user. In many cases, the user will treat the distraction by removing the hearing aid from the bad ear, and rely solely on the good ear to provide all of her hearing, as this is more pleasing aesthetically and is less distracting than having his hearing aid in her bad ear providing garbled sound information.

However, using only a single hearing air has drawbacks. In particular, the patient loses the sense of directionality that he obtains from having bilateral hearing. For example, if the user hears everything from his right ear and has no hearing out of this left ear, he cannot easily determine the direction from which a particular sound originates.

A further problem experienced by the user is that they are often unable to bear sounds that originate from the side of the user on which the bad ear is located. As such, a user sitting at a table might be able to very easily understand a conversation spoken by people sitting on his good ear side, but may not be able to hearing anything from those sitting on his bad ear side. This inability to hear well on one side forces the user to turn her head on a frequent basis so that her good ear is better positioned to pick up the sound originating from the side on which the bad ear is placed. This frequent head turning can also be dangerous when driving a motor vehicle, or awkward such as when trying to write notes and turning ones head often to be sure that you have heard the auditory information on which the notes are being taken.

Those with asymmetric hearing loss often try to find ways of compensating for their inability to hear well on one side. For example, persons having hearing in only one ear will often try to choose a place at a table where all of the other people at the table are seated on their "good ear side". Another compensation technique is for the user to sit at the end of the table facing all the other persons, so that the "bad ear side" is positioned so that no one is sitting directly on the bad ear side.

Known technological fixes exist for aiding in overcoming these issues. These methods include the use of "CROS" hearing aids, "BICROS" hearing aids, and bone-anchored hearing aids.

A CROS hearing aid is a type of hearing aid that is used to treat unilateral hearing loss. A CROS hearing aid takes sound from the patient's bad ear side and transmits the sound to the good ear with better hearing. Many systems use a wireless transmitter to transmit electrical signals from the bad ear hearing aid to the good ear hearing aid.

BAHA and Trans-cranial CROS systems use the conductivity of the skull to transmit sounds. See, e.g. *Wikipedia, CROS Hearing Aid*, https:/en.wikipedia,org/wiki/CROS_hearing-aid; See also Myrthe K. S. Hol; Sylvia J. W. Kunst et al, "Pilot Study on the Effectiveness of the Conventional CROS, the Transcranial CROSS and the BAHA Transcranial CROS in Adults with Unilateral Inner Ear Deafness", *European Archives of Oto-Rhino-Laryngology,* 2010, June 267(6), 889-896 (2009, Nov. 11).

A BICROS hearing aid system is primarily employed on patients who have little or no hearing on one side, with some hearing loss in their good ear. A BICROS system works similarly to a CROS system, except that the device on the good side is usually a fully capable hearing aid for receiving and amplifying sounds on the good ear side and is also capable of receiving the sound transmitted from the CROS hearing aid on the bad side.

BAHA (Bone Anchored Hearing Aid) is a hearing aid that is placed on the side of the bad ear, and transfers sound through bone conduction and stimulates the cochlea of the good ear. This system is designed to transmit sound from the bad side to the good hearing side to result in a sensation of hearing from the deaf ear. See umm.edu/PROGRAMS/HEARING/SERVICES/BONE-ANCHORED-DEVICE#UNILATERAL, University of Maryland Medical Center.

A BAHA hearing aid typically employs a biocompatible screw that is affixed into the skull behind the bad ear. The screw top is a coupling intended for a vibrating bone conductor hearing aid. The hearing aid vibrations are transmitted through the screw and into the skull bone and are transmitted through the skull to the opposite good ear. This is similar to a tuning fork placed on a bone so that the vibrations from the tuning fork vibrate the surfaces it touches and thereby transmits sound vibrations through the skull and to the ear.

The CROS, BICROS hearing aid and the Bone Anchored Hearing Aid provide significant advantages to the user, as they enable the user to hear information from both sides of his head. However, although they provide the hearing information to the user, known CROS, BICROS and BAHA hearing aids are not very effective in providing the patient with a sense of directionality. In essence, the user is hearing the information in "monoraul", and does not enjoy the stereophonic sound that a person with two normally functioning ears enjoys. Because of this monoraul hearing, the user can hear the information, but cannot determine whether the sounds that he is hearing are originating from his bad hearing side or good hearing side.

Therefore, one object of the present invention is to provide a device that enables the user to have better directionality as to the source of sounds and speakers voices.

III. SUMMARY OF THE INVENTION

In accordance with the present invention, a hearing aid apparatus is provided for use with a patient having a first ear and a second ear. The hearing aid apparatus comprises a first hearing aid member and a second hearing aid member. The first hearing aid member is placeable on a patient's body, and includes a first transducer for receiving sounds that would be received by the patient's first ear and converting those received sounds into first transmittable electrical signals. The second hearing aid member is placeable on a patient's body adjacent to the patient's second ear, and includes the receiver for receiving the first transmittable electrical signals and a second transducer for converting the first transmittable electrical signals into sound signals configured for delivery to the patient's second ear.

Preferably, one of the first and second hearing aid members includes a signal processor. The signal processor is provided for processing at least one of the first and second electrical signals to alter the at least one of the first and second electrical signals so that the altered one of the first and second electrical signals and the other one of the first and second electrical signals will have distinguishably different sound characteristics when converted from electrical signals to sound signals.

Most preferably, the signal processor of the second hearing aid processes a signal of the at least one of the first and second electrical signals to alter the signal by at least one of changing its pitch, inducing an echo, delaying the signal, filtering the signal, adding a chorus effect, attenuating different frequency bands, resonating the signal, adding an artifact signal, adding an artifact to the signal, changing the strength of the signal to alter its volume, and modulating the signal.

One of the features of the present invention is that a signal processor is provided that can alter one of the first and second signals, so that the altered one of the first and second signals produces a sound that is auditorily distinguishable from the unaltered one of the first and second signals. This feature has the advantage of providing the user with some means for determining directionality of the signal. For example, if the patient's "bad ear" is the patient's first ear, and the patient's "good ear" (or at least relatively better ear) is the patient's second ear, the device is designed to receive sound from the first side of the patient, and then alter the sound so that the sound has a different tonal quality than the sound of the second signal.

Hopefully, the user will learn to recognize this difference in tonal quality, so that the user can help to make a determination based on this difference in tonal quality as to whether the sound is originating from the patient's first ear side, or the patient's second ear side. By so doing this, a patient who has only one good ear, or who more particularly only has one ear that is capable of receiving relatively high fidelity sounds, and as such, is relegated to have something of a "monoraul" hearing will be able to have something that approximates a "stereophonic" hearing, that will help the user to provide him with some sound directionality.

In another embodiment, sound information can be transferred between the user's "bad side ear" and the user's "good side ear" through the use of a bone anchored hearing aid. Such a bone anchored hearing aid vibrates or induces vibrations into the bone structure of the user's head, so that the vibrations can be transmitted from the user's bad side to the user's good side, and then converted into sound energy, so that the user can also obtain the illusion of stereo phonic, bi-directional hearing.

These and other features of the present invention will become apparent to those skilled in the art, upon a review of the detailed description, claims and drawings set forth below.

IV. BRIEF DESCRIPTION OF THE DRAWINGS

Figure 6:
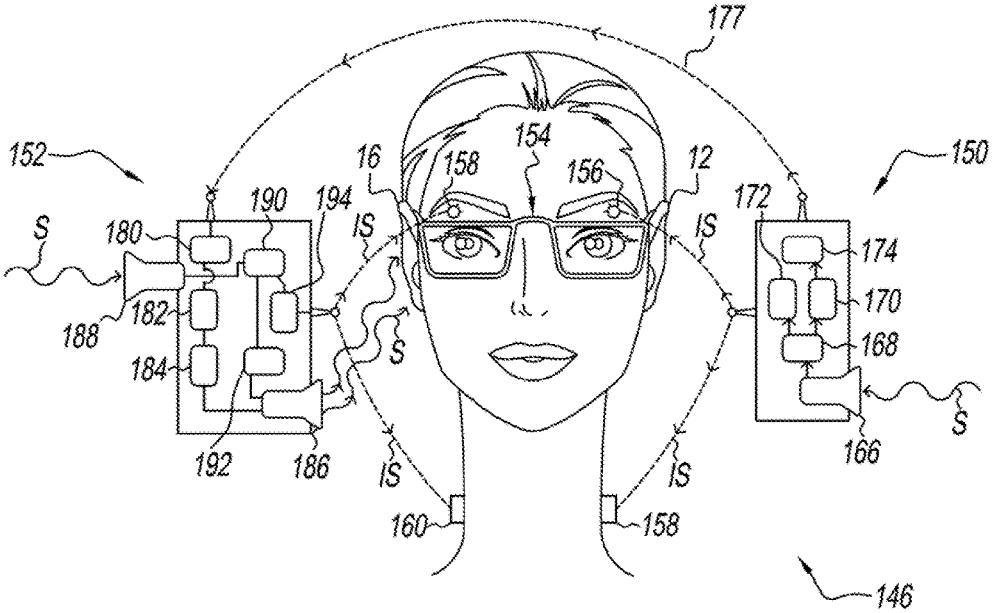
Figure 7:
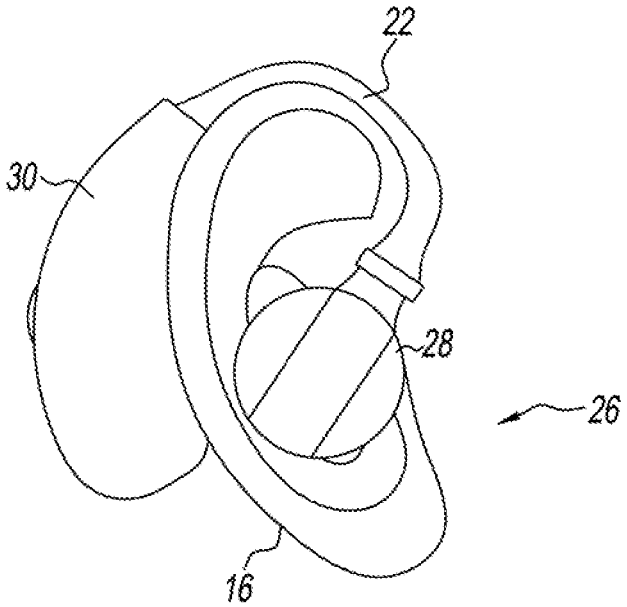

FIG. 6 is an alternate embodiment hearing aid system of the present invention, that can incorporate any of the hearing aid systems of the present invention, but to which is added both a visual and a vibratory direction indicator to help the user identify sound direction; and FIG. 7 is a schematic view of a prior art hearing aid, to show the type of packaging in which the hearing aid system of the present invention may be placed.

V. DETAILED DESCRIPTION OF INVENTION

The description that follows describes, illustrates and exemplifies one or more particular embodiments of the present invention in accordance with its principles. This description is not provided to limit the invention to the embodiment or embodiments described herein, but rather to explain and teach the principles of the invention in such a way to enable one of ordinary skill in the art to understand these principles and, with that understanding, be able to apply them to practice not only the embodiment or embodiments described herein, but also other embodiments that may come to mind in accordance with these principles.

The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing reference numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose.

Furthermore, certain views are side views which depict only one side of the vehicle (or one set of components of a multi set array of components), but it will be understood that the opposite side and other component sets are preferably identical thereto. The present specification is intended to be taken as a whole and interpreted in accordance with the principles of the present invention as taught herein and understood by one of ordinary skill in the art.

There are also certain conventions with regard to language that are specific to this application. For example, the term "unilateral hearing loss" relates to a hearing loss wherein the hearing loss suffered by one ear is different from, and usually greater, than the hearing loss suffered by a second ear. As such, there may be hearing loss in both ears that fall within the term "unilateral hearing loss" as used in this application. However, as discussed above, the primary perceived use for the present invention at this time is for patients who have a "unilateral hearing loss" wherein the difference in hearing loss between one ear and the other is significant enough to warrant the special consideration of using the hearing aid device of the present invention, rather than a more typical conventional hearing aid.

A further convention used in this application, is that the terms "bad ear" and "good ear" are used. It will be appreciated that the term "bad ear" and "good ear" are relative terms, with the term "bad ear" being used to designate the particular one of the two ears that suffers a more profound hearing loss than the other ear.

To help maintain consistency in this application, the left ear 12 of the patient P has been designated as the "bad ear" and the patient's right ear 16 has been designated as the "good ear". Those skilled in the art will recognize that this choice of left and right as good and bad ears is purely arbitrary, and that it is just as likely that any particular patient's right ear will be his bad ear, and that his left ear will be his good ear.

Figure 1:
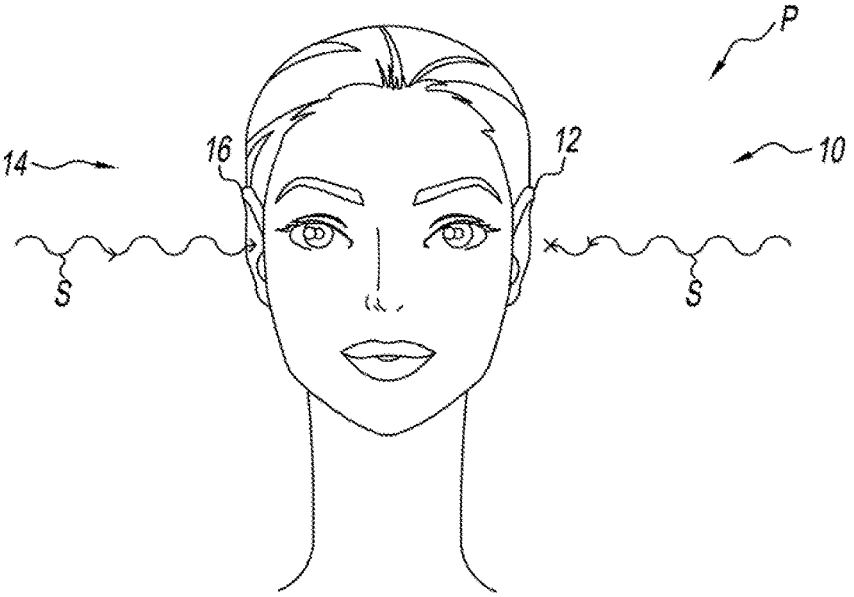
FIG. 1 is a schematic view of a patient having a unilateral hearing loss, without correction, either via the prior art, or the instant invention.

Your attention is now directed to the figures that illustrate the invention and in particular, FIG. 1. FIG. 1 shows a patient having a left side 10 that includes a left ear 12, and a right side 14 that includes a right ear 16. Patient P has a unilateral hearing loss. As illustrated in the drawings, the sound wave S that is shown adjacent to the left ear 12, includes an "X" at its distal end, to indicate that the sound wave reaches the ear, but does not penetrate into the hearing receptors within the brain of the user and as such are not "beard". As discussed in the inventor's other ear related patent applications, all of which are incorporated herein, the typical reason for such a hearing loss springs from malfunctions within one of the organs of the ear, such as the ear drum, the bones of the middle ear, or often the cochlea and its various component parts. A further discussion of diseases of the ear, and reasons for hearing loss are available from a wide variety of sources, and particularly, text books relating to diseases of the ear.

By contrast, the sound wave arrow S that is shown adjacent to the right or good ear 16 has an arrow at the end. The use of the arrow is a convention adopted in this application to indicate that the right ear has some auditory acuity, or in particular, greater auditory acuity and hearing capability than that of the bad or left ear 12. As will be discussed in more detail below, patients exist who have a total hearing loss in their bad ear 12, but perfect hearing in their good ear 16. Other patients exist who have a hearing loss in both their good ear 12 and their bad ear 16, although the hearing loss in their bad ear 12 is more profound than the hearing loss out of their good ear.

Figure 2:
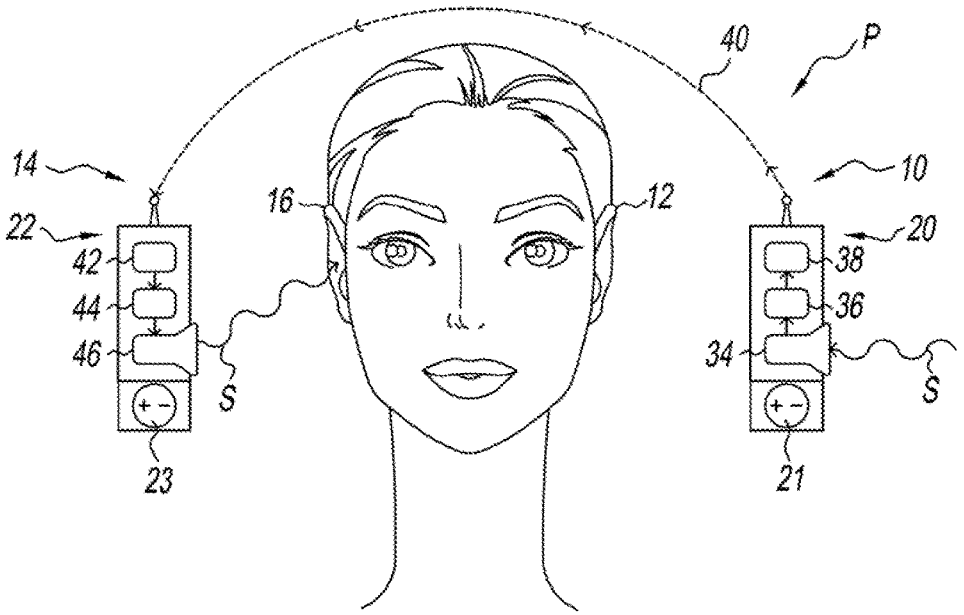
FIG. 2 is a schematic view of a user having prior art CROS hearing aid system used for treating a unilateral hearing loss.

A prior art device used for treating unilateral hearing loss is shown in FIG. 2.

In FIG. 2, a patient is shown having a left side 10 and a right side 14, a left eat 12 and a right ear 16. Patient P also has a hearing aid apparatus that is shown schematically as comprising a first hearing aid member 20 that is designed for placement on the bad ear side 10 of the patient and preferably placed adjacent to or in the left or bad ear 12. The hearing aid apparatus also includes a second hearing aid member 22 that is placed on the good hearing side 14 adjacent to the good ear 16, and is provided for broadcasting sound waves S into the patient's ear so that the user can have a hearing sensation.

To help understand the operation of the present invention, the hearing aids 20, 22 shown in FIG. 2, along with the hearing aids shown in the remainder of the application are shown schematically, and are positioned in a spaced relation from the user's head, so as to help keep the drawings more clean. However, in practice, a hearing aid will be employed that likely has an appearance and external construction similar to the prior art hearing aid shown in FIG. 7. As shown in FIG. 7, the prior hearing aid 26 includes an ear globe portion 28, a case portion 30, and a connector 32 for connecting the case 30, with the ear globe 28. The case 30 includes an interior space for housing the circuitry for the device 26, along with batteries to power the device 26. Additionally, the case 30 may include various circuitry for processing sound along with a microphone-type transducer for picking up ambient sound around the user's ear.

The hearing globe 28 is preferably designed to be custom molded to fit snugly and securely within the user's ear. The hearing globe 28 can include processing circuitry and a first transducer such as a microphone, if it is preferred to place one in the globe 28 rather than the casing. However, the primary component that is contained within globe 28 is a second transducer, such as a loud speaker type transducer that is provided for broadcasting or delivering sound into the user's ear and more particularly, into the ear canal of the user's ear, so that the sound delivered therein can impact the user's eardrum, which in turn, activates the bones of the middle ear, which in turn actuate the cochlea, and the various components therein.

In addition to the hearing aid shown in FIG. 7, the reader's attention is directed to discussions of other hearing aid cases and types that likely would also serve as suitable casings for the present invention. For example, larger, cigarette pack-sized body cases are used with some hearing aids, since they have greater room for additional circuits and have greater room to hold batteries to provide them with a longer battery life. The body cases also usually have less expensive manufacturing costs and circuitry costs due to the fact that the greater volume of the case provides room for additional batteries, and reduces the enhanced costs associated with ultra miniaturization of components, as must occur to get all the appropriate components and batteries to fit within a small size case such as the behind-the-ear case 30 shown in FIG. 7.

A schematic representation of the prior art hearing aid 10 is shown in FIG. 2, as including a first hearing aid member 20 that is placed adjacent to the user's bad ear 12, and a second hearing aid member 22 that is placed adjacent to the user's good ear 16. The first hearing aid 20 includes a power source such as a battery 21 to provide power for the electrical circuitry within the hearing aid. A battery 23 is also provided in second hearing aid 22 to provide power to the electrical circuitry within the hearing aid 22.

Battery members that will work well are known within the prior art. Although battery members 21, 23 are shown in the prior art hearing aids, 20, 22, they are not shown in the remaining hearing aids of the present invention. However, it will be understood that the absence of showing the power sources within these hearing aids of the present invention is not an indication of a lack of a power source in the devices. Rather, the power sources were not shown to simplify the drawings, as it will be well understood that conventional power source batteries would likely usually need to be included in each of the hearing aid members of the present invention.

The transducer 34 is a microphone type transducer that is assigned to pick up ambient sounds that would otherwise be picked up by the user's ear. Sound waves S that enter the transducer, are "transduced" from sound wave signals to electrical signals that are delivered to a processor 36. Processor 36 performs some processing on the signal before delivering the signal to transmitter 38. Transmitter 38 is provided for sending a wireless signal 40 to a receiver 42 that is housed within the second hearing aid member 22.

For purposes of illustration, the transducer 34, processor 36 and transmitter 38 are shown as separate components. However, it will be appreciated, that the components can be designed to be a single unit or designed in any other fashion that provides a product that serves its intended purpose and meets all performance, size and cost-requirements.

The external antenna shown on the hearing aid 20 is shown also for illustrative purposes, it being envisioned that an internal antenna will be used in the actual model.

The hearing aid member, that is placed adjacent to the good ear 16, is preferably designed to have an appearance similar to the hearing aid shown in FIG. 7. The hearing aid includes a receiver 42 for receiving the wireless signal from transmitter 38 of the first hearing aid member 20. It has been found that a wireless transmitter is much preferred over a wire transmitter because of reasons of convenience and aesthetics. The electrical signal received by receiver 42 is transmitted to a processor, which may perform little to no processing, or may just be a processor such as an amplifier that amplifies the signal prior to sending the signal to the transducer 46. The second transducer 47 comprises a transducer such as a loud speaker, for converting electrical energy to sound energy S. The sound waves S are broadcast into the ear canal of the user, for delivery to the ear structure including the ear drum that is disposed at the inner portion of the ear canal.

Figure 3:
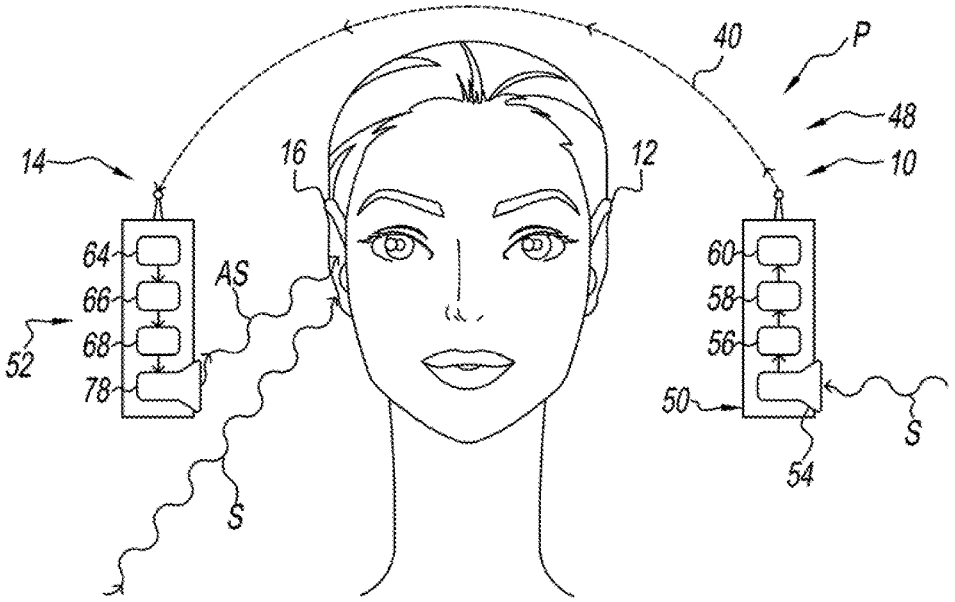
FIG. 3 is a schematic view of a user having a CROS type hearing aid system of the present invention to help treat a unilateral hearing loss.

A CROS-type hearing aid system 48 of the present invention is shown in FIG. 3. A CROS system is normally employed when the bad ear has a significant hearing loss, but the good ear has hearing within the normal range, and as such, does not need the amplification that is provided by a typical hearing aid.

The hearing aid system 48 of the present invention includes a first hearing aid member 50 that is placeable on a patient's body and is usually positioned on the same side 10 of the patient's body as the bad ear 12 for receiving sounds that would normally be received by the patient's first ear 12. A second hearing aid member 52 is also provided that is placeable on a patient's body adjacent to the patient's second or good ear 16. As a second hearing aid member is provided for broadcasting sound information into the patient's good ear 16, it is preferred that the second hearing aid member 52 be positioned on the user's ear, so that the sound produced by the transducer 78 of the second hearing aid member can be delivered directly and closely to the patient's ear structure, such as the patient's ear canal and eardrum.

The first hearing aid member 50 includes a first transducer 54 that is provided for receiving sound energy S. Sound energy S is preferably of the type and nature of sound energy that would normally be picked up by the patient's bad ear 12 if the patient's bad ear 12 had normal hearing. The transducer 54 is preferably a microphone transducer.

As will be appreciated by those familiar with the microphone art, various types of microphone transducers are available but have different "pick-up patterns". The pick-up pattern for a particular microphone is chosen depending upon the nature of the sound that is desired to be picked up. For example, some microphone transducers in use in applications other than hearing aids comprise conference-type microphones that are designed to pick up sound signals in an omnidirectional pick-up pattern including those sound signals that are delivered close to the microphone, and also those sound signals that are relatively far away from the microphone. On the other hand, other microphones may be unidirectional and designed to only pick up sounds that are delivered very close to the microphone, so as to reduce the background noise picked up by such microphones. The choice of preferred transducer is determined by the user and medical practitioner and is chosen to best serve the purposes that are intended for the microphone transducer 54.

The transducer 54 is provided for converting sound energy into a first electrical transmittable signal that is transmitted to a first signal processor 56. The first signal processor 56 processes the signal such as by amplifying it, conditioning it, or the like.

The first processor 56 then forwards a transmitted signal to a signal alteration processor 58. The purpose of signal alternation processor 58 is to alter the signal so that there is an altered sound AS that is produced different than the sound signal S that is delivered in the user's ear.

Although the drawings show the processors 56, 58 as being separate units, it is important to note that this is done for purposes of illustration and clarity. In practice, it is likely that a single processor will be used that will engage in traditional functions such as amplification of the signal, along with alteration functions.

The altered signal that emerges from altered signal processor 58 is then transmitted to a transmitter 60 that transmits a wireless signal to a receiver 64 of the second hearing aid member 52. Receiver 64 is generally similar to the receiver of the prior art hearing aid. The signal received by the receiver 64 is forwarded to a signal processor 66 that then forwards the signal to a signal alteration processor 68.

Depending upon the signal, and the functionality of the device, it is likely that there is a need for only one signal alteration processor. As such, in practice, either signal alteration processor 58 or signal alternation processor 60 can be eliminated. The purpose of showing a pair of signal alternation processors 58, 60 is to illustrate that the signal alteration processing function can be contained here within the first hearing aid member 50 or the second hearing air member 52, at the choice of the designer of the unit. Additionally, it is possible that the electrical sound signal that passes through the first and second hearing aid members 50, 52 requires only processing by a single processor, thus permitting the user and/or designer to eliminate one or both of conventional signal processors 56, 66.

The output of the second hearing aid member 52 comprises an altered signal AS that is delivered to the patient's ear. Additionally, since the patient does not have a hearing loss in her good ear 16, the patient would also receive ambient sound S into her ear. As such, two streams of sound information, including sound S and altered sound AS are being fed into a single ear 16. Therefore the user is obtaining two channels of information in a single ear 16, which results in a monoraul hearing rather than a stereophonic or binaural hearing that is enjoyed by a person with most hearing.

The alteration incorporated into the altered signal is intended to help remedy this problem by making the altered signal to have a sound that is distinguishable from the primary signal S, so that the user in time can distinguish between altered signal AS and a regular signal S. By so recognizing the altered signal AS, the user can learn to appreciate directionality, as the user should learn to recognize the altered signal AS and recognize that the altered signal comes from the user's bad ear 12 side 10 rather than from the user's good ear 16 side 14.

Figure 4:
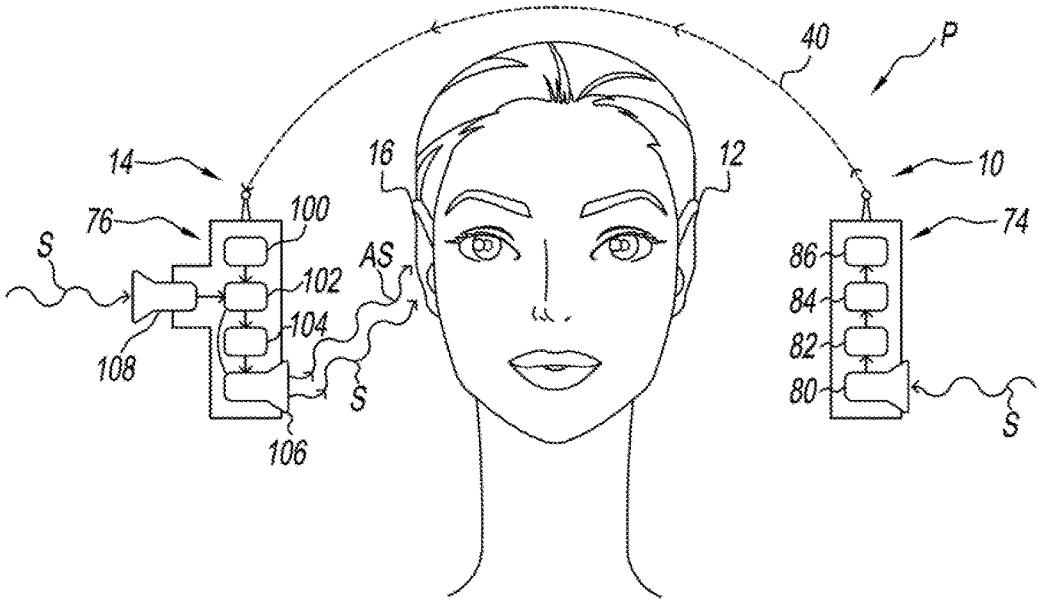
FIG. 4 is a schematic view of a user using a BICROS hearing aid system of the present invention to help treat a unilateral hearing loss.

Although the signal from the patient's bad ear side 12 is shown as being the altered signal, it will be appreciated that the rolls could be reversed, such as in the BICROS device of FIG. 4, which processes both the regular signal S and the altered signal AS, such that the altered signal emanates from the patient's good side 14 and the regular unaltered signal eminates from the patient's bad ear 12 side 10.

The purpose of using a signal alteration processor is to alter the sound from either the patient's bad ear side, or the patient's good ear side, so that the altered one of the first and second sound signals and the other non-altered of the first and second sound signals will have distinguishably different sound characteristics, when converted to electrical signals to sound signals. A variety of ways exist through which the sound can be altered. For example, the sound can be altered by changing its pitch, so that the altered sound has a higher or lower pitch than the non-altered sound. Additionally, an echo can be induced into the altered sound, so that it sounds different. Further, one can delay the signal, so that the first and second signals are off set temporally. Delaying the sound temporally helps to provide a difference that may be distinguishable.

Further, the signal can be filtered such as by passing it through a high pass or a low pass filter, to change the characteristic of the signal. Through this, the pitch of the signal for example can be lowered or raised. Further, a chorus effect can be added to the signal, such that one signal plays at a harmonic to a second signal, or at least sounds as though it was a second signal distinct from the first sound signal.

Also, different frequency bands can be attenuated to alter the signal. Another way of altering the signal is to ressonate the signal. Further, an artifact can be added to the signal. An artifact such as a hum or a click or a tone or the like can be added to one signal so that the user can distinguish the artifact added signal from the "clean signal". Further, the strength of the signal can be changed to alternate the volume. Another way of treating the signal to alter it is to modulate the signal.

There are several ways that artifacts can be added. These artifacts can include a vibration added to the sound, a humming sound, or an added tone to the altered signal. A sound artifact or sound transformation is preferably incorporated into the altered signal so that the sound has a difference from the sound as being received from the user's other ear. As discussed above, either the bad ear signal or the good ear signal can be altered, depending upon user preference. Preferably, the signal alteration processor 58 or 68 adds some sort of sound artifact or sound transformation so that the user can tell the difference between the first altered signal, and the second unaltered signal from the other ear.

In one embodiment, the artifact that is inserted is a distinct sound difference that is added onto the signal. For example, the tone can be a multi-type tone, a crackling type tone, a clicking type tone, a hum type or other type of tone. Any number of additional added sounds could be used to distinguish the first altered sound signal from the second, unaltered sound signal so that the user can differentiate between a sound picked up by the user's "good ear" and a sound picked up by the user's "bad ear".

By adding an artifact to the signal of one hearing member such as the first hearing member 50 that picks up sound adjacent to the user's bad ear 12 but not the signal received into the user's good ear, such as sound signal S of FIG. 3, or the sound signal picked up by transducer 108 in the BICROS embodiment of FIG. 4, the user effectively hears two signals of information, one with an artifact and one without an artifact. Over time, the user will be able to differentiate between the two signals to help the user distinguish between the artifact containing signal and the non-artifact containing signal.

Ultimately, the user will come to recognize that the artifact containing signals emanated from his bad ear side (in a case where the bad ear side signal is altered), and the non-artifact signal was emanating from the user's good ear 16 side 14. Through this process, the user will be able to gain some sort of simulated stereophonic hearing in geolocation of sound.

Another artifact that can be incorporated is a voice transposition type of artifact. In a voice transposition type of artifact, one might alter the tone of the signal coming from the first hearing aid member 50, as compared to the tone coming from the good ear side 14. For example, the tone could be raised an octave or lowered an octave. Additionally, the sound could be altered to sound more "tinny" to sound "deeper" or the like.

Preferably, the hearing aid device 48 is designed so that it can be programmed by the user to provide different artifacts of the user's choosing. For example, some might wish to have an altered sound coming from the bad side (hearing member) to include an artifact that changes the sound to simulate that of a famous actor, voice talent or the like, or a cartoon character. In operation, the user would be given a first hearing aid member 50 and a second hearing aid member 52 into which a suitable artifact would be programmed.

FIG. 4 shows a hearing aid system 72 that comprises a BICROS type system. As discussed above, a BICROS system is used when the user has a hearing loss in both his bad ear 12 and his good ear 16, so that both the signals from the bad side 10 and good side 14 need to be treated by hearing aids.

A BICROS system includes a first hearing aid member 74 and a second hearing aid member 76. First hearing aid member 74 is generally similar to first hearing aid member 50 shown in three of the CROS design. In particular, first hearing aid member 74 includes a transducer 80 that comprises a microphone, for receiving sounds S. Preferably, the first hearing aid member 74 is positioned close to the bad ear 12 of the user, so that the sounds S picked up by the first transducer can positionally replicate the sounds that would be picked up by the user's bad ear 12, if the ear were working properly.

The first transducer 80 is provided for converting sound energy to a transmittable electrical signal that is transported to the first signal processor 82. The first signal processor 82 processes the signal and forwards it to a first signal alteration processor 84, that is provided for adding the artifact or otherwise altering the sound so that the altered sound AS that is delivered by the second transducer 106 of the second hearing aid member 76 is sufficiently distinguishable from the unaltered sound S, so that the user can hear the difference and distinguish the difference between the unaltered sound S and the altered sound AS that is delivered to the ear.

The electrical signal that emanates from the signal alteration processor 84 is then delivered to transmitter 86 which transmits a wireless signal 40 to the receiver 100 of the second hearing aid member 76. The receiver 100 delivers a signal to a signal processor 102, and a signal alteration processor 104. The altered signal is then forwarded to the second transducer 106, which broadcasts both an altered sound signal AS and an unaltered sound signal S into the patient's good ear 16.

In this regard, the second hearing aid member 76 is similar to second hearing aid member 52 of the CROS member. However, a difference with the second hearing aid member 76 is that the second hearing aid member 76 also includes a first transducer 108 that preferably comprises a microphone type transducer, similar to first transducer 80 of the first hearing aid member 74. The first transducer 108 is provided for picking up sound signals that are similar due to position, to the sound signals that would be picked up by the user's good ear 16, if the user's good ear 16 did not need augmentation.

The sound picked up by the first transducer 108 can also be delivered through the signal processor 102 that processes the signal separately from the altered signal, and delivers the signal that emanates from the processor 102 to the transducer 106. Preferably, the signal that comes from the first transducer 108 bypasses the signal alteration processor 104, so that no alteration is made of the signal that originates from the first transducer 108.

Nonetheless, it may be worthwhile to perform some processing on the signals through the signal processor 102, such as by amplifying the signal, or changing the volume of the signal so that the sound signal delivered by the second transducer 106 to the ear of the patient will be at an appropriate volume.

Figure 5:
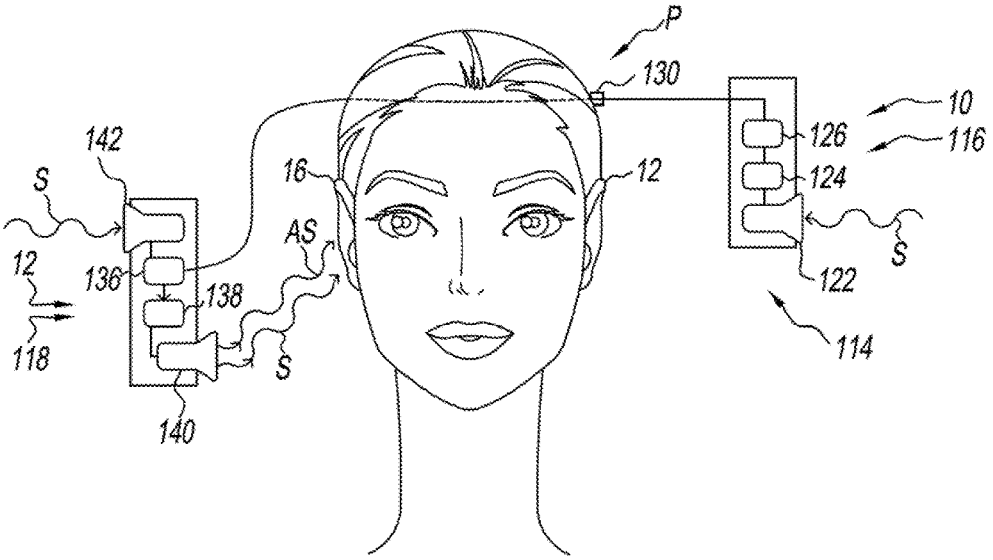
FIG. 5 is a schematic view of a user having a BAHA type hearing aid system of the present invention for treating a unilateral hearing loss.

A BAHA (bone anchored hearing aid) system 114 is shown in FIG. 5. As discussed above, a primary difference between a BAHA type system 114, and the other system such as discussed herein is that a BAHA system transmits signals from the first hearing aid member 116 on the bad ear side 12 to the second hearing aid member 118 on the good ear side 14 by using the skull bone of the patient as a medium through which to transmit sounds and vibrations.

As sounds are being transmitted through the bone, the signal processor used within the hearing aid tends to be amplifier-type processors. A wireless transmitter and receiver are not needed as no wireless signal is being transmitted between the first hearing aid member 116 and the second hearing aid member 118.

The BAHA hearing aid system 114 includes a first hearing aid member 116 that is positioned on the patient somewhere near the bad ear 12 side of the patient to receive sounds. A second hearing aid member 118 is placeable on the good ear 16 side of the patient and is provided for delivering sound waves S into the ear 16 of the patient. As has been used conventionally herein, the "AS" wave is for the altered sound wave, whereas "S" is for an unaltered sound wave.

The first hearing aid member 116 includes a first transducer 122 of a microphone-type for receiving ambient sounds that would normally be picked up by the patient P's ear, if the patient's bad ear 12 were normal. The first transducer feeds the signal to a first signal processor 24 which feeds the signal to a first signal alteration processor 126.

The alteration signal processor 126 inserts an alteration to the signal, such as a change in tone, or the addition of an artifact, so that the signal becomes distinguishably different from an unaltered signal to help the patient P distinguish between the signal received from his left side through the first hearing aid member 116 in the signal received by the patient's right side by the second hearing aid member I 18. As also discussed above, the present invention contemplates that a signal will be altered. However, it is not limited to altering the signal in the first hearing aid 116, as the signal can just as well be altered by the signal alteration processor 138 of the second hearing air member. The second hearing aid member 118 includes a first signal processor 126 for processing the signal received from the first hearing aid member 116.

A bone screw 130 couples the first hearing aid member 116 to the skull of a patient, so that by vibrations induced in the bone screw 130 can be induced into the skull, and transmitted through the patient's skull to a suitable receiver or wire that transmits the bone signal to the first signal processor 136 of the second hearing aid member 118. The signal from this first signal processor 136 is conveyed to the signal alteration processor 138 which may or may not exist, depending upon whether the signal alteration is handled by the signal alteration processor 126 of the first hearing aid. The altered signal AS is then transmitted to the transducer 140 of a loud speaker type that then converts the electrical signal energy into audio energy.

The BAHA hearing aid system 114 of the present invention is shown as being a BICROS system that includes the first transducer 142 of a microphone type that is part of the second hearing aid member 118. The transducer 142 picks up ambient sound waves S and then converts it into an electrical signal, and then delivered to the first signal processor 136, and ultimately to the transducer 140, where the sound is reconverted into a sound type signal S.

Although the convention discussed herein has normally contemplated that the sound picked up by the first hearing aid member 116 will be altered to produce the altered signal AS, it is also contemplated that the sound picked up by the first hearing aid member 116 could be unaltered with the sound S being picked up by the first transducer 142 of the second hearing aid member 118 from the patient's good ear 16 side being processed through the signal alteration processor 138 to produce the altered signal. As such, it is not necessarily that important which of the two signals (good side or bad side) is altered, so long as one of the two signals is altered.

Conceivably it would help the user to distinguish the two sounds coming from different sides of his head, it is both of the sound received bad ear side 12, and the sound received from the good ear 16 side could both be altered.

Another embodiment is shown in FIG. 6 that includes an indicia indicator to also help the user better determine directionality. The two particular types of indicia shown in FIG. 6 include a light indicia and a vibrational indicia. Although both a light and vibrational indicia can be used with the same patient, it is contemplated that normally one of the two will be selected, as the use of two indicia may be something of an over kill.

The indicia containing hearing aid system 146 includes a first hearing aid member 150 that is disposed on a patient's bad ear 12 side, and a second hearing aid member 152 that is disposed on the patient's good ear 16 side. A patient P shown as wearing a pair of glasses 154, upon which a first light based indicia 156 is mounted, and a second light based indicia 158 is mounted. To aid in directionality, the first light based indicia 156 is mounted closer to the patient's left eye and is designed to turn on and emit light in some fashion that correlates with sound that is being picked up by the first transducer 166 of the first hearing aid member 150 that picks up the sound from the patient's bad ear 12 side.

The second light indicia member 158 is positioned adjacent to the user's right eye and is designed to give off light that correlates to sound S that is being picked up by the first transducer 188 of the second hearing aid member 152 that is positioned on the patient's good ear 16 side.

The light indicia 156, 158 are designed to help the patient determine directionality because the patient will be able to associate the light emitted by the respective first and second lights 156, 158 with the sound that he is hearing S, AS that is generated by the transducer 186 of the second aid member 152. This use of both sound and tactile differentiating indicia is believed to be useful in helping the patient distinguish the sounds and hence, be able to get a simulated directionality from the sounds.

The second indicia member comprises a first vibratory indicia member 158 that is positioned on the patient's bad ear 12 side and a second vibratory indicia member 160 that is positioned on the patient's good ear 16 side. The vibration induced in the user by the first and second vibrational members 158, 160 should correlate with the sounds being received on the patient's bad ear 12 side and the patient's good ear 16 side respectively. Although the vibratory members 158, 160 are being shown as being placed on the patient's neck, the vibration members can be placed anywhere that is convenient and distinguishable by the patient.

The vibratory members 158, 160 and light indicia members 154, 158 should all include wireless receivers for receiving a wireless signal from the respective first and second hearing aid members 150, 152 and be able to respond to those wireless signals to turn on and off respectively.

The indicia containing hearing aid system 146 includes a first hearing aid member 150 that includes a first transducer for receiving sounds that can be picked up from the patient's bad ear 12 side. The transducer 166 is a microphone transducer that converts sound energy into a transmittable electric signal that is conveyed to a first signal processor 168 that then conveys the signal to a signal alteration processor 170. As discussed above, the signal alteration processor 170 can alter the signal such as by changing its tone, volume, pitch or adding an artifact, so that the sound has an auditorially distinguishable sound from an unaltered signal.

The sound is then conveyed to a wireless transmitter 174 that sends a wireless signal 177 to a wireless receiver 180 of the second hearing aid member 152. Second hearing aid member 152 includes a wireless receiver, which receives the signal 177 from the first hearing aid member 150, and conveys the signal to a signal processor 182, and then, optionally, to an alteration signal processor 184. The signal that leaves the alteration signal processor 184 is then delivered to a second transducer 186 of a loud speaker type that converts the electrical signal into a sound energy signal. As the signal has been altered, the sound signal which is produced by the second transducer 186 is the altered signal AS that is delivered to the patient's ear.

It will be noted that the circuitry is schematically represented in second hearing aid member 152 in a slightly different manner from the manner in which the circuitry is illustrated in the other embodiments. In particular, the circuitry of the second hearing aid member 152 shown as having two distinct and non-overlapping circuit paths, wherein the signal 177 that is received from the first bearing aid member 150 follows a completely different path and is processed by a completely different components than the signal received by transducer 188 of the second hearing aid member. It will be appreciated that benefits and drawbacks exist with such a separate circuitry design, as opposed to the combined circuitry shown on the other embodiments.

The second hearing air member 152 includes a first transducer 188 that picks up ambient sounds on the patient's good ear 16 side, and converts those sounds into an electrical signal that is then directed to a signal processor 190. The signal processor 190 sends out two streams of information, including a first stream of information that is sent to a signal alteration processor 182 that then conveys the sound to the second transducer 186, where it is converted from an electrical signal into a sound signal S. The second stream of information is fed to an indicia signal processor 194 that includes a wireless transmitter for transmitting an indicia signal to one or both of the light indicia 158, and vibratory indicia 160.

In use, the hearing aid system 146 of the present invention receives sound information from each of the bad ear side 12 and good ear side 16. In addition to the sounds being processed so that you have an altered sound signal AS that is distinguishable from an unaltered sound signal to enable the user to help distinguish between the sounds received on his bad ear 12 side and his good ear side, an indicia such as the light indicia or vibratory indicia are also provided to correlate with the sounds to provide the user with another source of information relating to the direction from which the particular sound emanates, to better help the user achieve a sense of directionality from the sound, even without the stereophonic hearing that is provided to normal hearing persons through the use of two functioning ears.

Although the invention has been described with reference to certain detailed embodiments, it will be appreciated that variations and modifications exist within the scope and spirit of the claims as appended hereto.

What is claimed:

1. A hearing aid apparatus for use with a patient having a first ear and a first body side on which the first ear is disposed, and a second ear and a second body side on which the second ear is disposed, wherein the first has a hearing loss sufficiently profound that a normal approximately symmetric hearing condition is incapable of being substantially restored with an amplification adjusted hearing aid, the hearing aid apparatus being configured for enabling the patient to hear sounds that original from a plurality of directions, the hearing aid apparatus comprising:

a first hearing aid member placeable on a patient's body on the same side of the patient's body as the first ear, the first hearing aid member including a first transducer for receiving sounds that would be received by the patient's first ear and converting those received sounds into first transmittable electrical signals, a second hearing aid member placeable on the patient's second body side, the second hearing aid member including a second transducer for receiving sounds that would be received by the patient's second ear, and converting the received sounds into second electrical signals, a receiver for receiving the first transmittable electrical signals, and a first signal processor for processing the second electrical signals and first transmittable electrical signals into signals configured for being received by the patient's second ear for facilitating the hearing of sounds that would be received by both of the patient's first and second ears, wherein the only hearable sound signals received by the patient's ear are generated through the second hearing aid member, and further comprising a signal alteration processor for altering one of the first transmittable electrical signal and second electrical signal so that the patient can hear differences between sounds received by the first hearing aid member and sounds received by the second hearing aid member to permit the patient to distinguish between sounds received by the first hearing aid member and sounds received by the second hearing aid member to aid the patient, in achieving a sense of the direction of origin of the sounds being output into the second ear.

2. The hearing aid apparatus of claim 1 further comprising a second signal processor, the second signal processor including the signal alteration processor, the second signal processor being configured for processing at least one of the first transmittable electrical signal and, second electrical signal to have distinguishably different sound characteristics when converted from electrical signals to sound signals.

3. The hearing aid apparatus of claim 2 wherein the signal alteration processor is contained on at least one of the first and second hearing aid members, and wherein the second signal processor processes the at least one of the first transmittable electrical signal and, second electrical signal to alter the signal by at least one of changing its pitch, inducing an echo, delaying the signal, filtering the signal, adding a chorus effect, attenuating different frequency bands, resonating the signal, adding an artifact to the signal, changing the strength of the signal to alter its volume and modulating the signal.

4. The hearing aid apparatus of claim 3 wherein the artifact includes at least one of a vibration, a humming sound, and an added tone.

5. The hearing, aid apparatus of claim 1, wherein the signal alteration processor is included in the first signal processor.

6. The hearing aid apparatus of claim 1 where the signal alteration processor is configured for altering both of the first transmittable electrical signal and second electrical signal.

7. The hearing aid apparatus of claim 6, wherein both of the first transmittable electrical signal and second electrical signal are altered by the signal alteration processor by at least one of changing pitch, inducing an echo, delaying the signal, filtering the signal, adding a chorus effect, attenuating one or more frequency bands, resonating the signal, adding an artifact to the signal, changing the strength of the signal to alter its volume, and modulating the signal.

8. The hearing aid apparatus of claim 1, wherein the first hearing aid member includes a wireless transmitter for transmitting the first transmitted electrical signal to the second hearing aid member.

9. The hearing aid apparatus of claim 1, wherein the first hearing aid member includes the first signal processor processing the first transmittable electrical signal for altering characteristics of sound produced by the first transmittable electrical signal.

10. The hearing aid of claim 9 wherein the signal alteration processor of the first signal processor of the first hearing, aid member is configured to process the first transmitted electrical signal to alter the characteristics of the sound by at least one of changing its pitch, inducing an echo, delaying the signal, filtering the signal, adding, a chorus effect, attenuating one or more frequency bands, resonating the signal, changing the strength of the signal to alter its volume, adding an artifact to the, signal and modulating the, signal.

11. A hearing aid apparatus for use with a patient having a first ear and a first body side on which the first ear is disposed, and a second ear and a second body side on which the second ear is disposed, wherein the first ear has a hearing loss sufficiently profound that a normal approximately symmetric hearing condition is incapable of being substantially restored with an amplification adjusted hearing aid and wherein the second ear is capable of hearing sound signals, the hearing aid apparatus configured for enabling the patient to hear sounds that original from a plurality of directions, the hearing apparatus comprising:

a first hearing aid member placeable on a patient's body on a patient's first body side, the first hearing aid member including a first transducer for receiving sounds that would be received by the, patient's first ear and converting those received sounds into first transmittable electric signals a second hearing aid member placeable on a patient's second body side, the second hearing aid member including a second transducer for receiving sounds that would be received by the patient's second ear and converting the received sounds into second electrical signals, a receiver for receiving the first transmittable electrical signals, and a first signal processor for processing the first transmittable electrical signals and the second electrical signals into signals configured for being received by the patient's second ear for facilitating the hearing of sounds that would be received by both of the patient's first and second ears, wherein the first signal processor includes a signal processor for processing one of the first transmittable electrical signal and second electrical signal, and a non0sound producing indicia member in communication with the signal processor configured providing one of a tactile or visual signal to the patient to aid the patient in achieving a sense of direction of origin of the sounds being output into the second car.

12. The hearing aid apparatus of claim 11 wherein the indicia member comprises a first vibratory member positioned on the first body side of the patient, the first vibratory member being configured for emitting a vibratory signal of variable intensity that can be felt by the patient, and a second vibratory member positioned on the second body side of the patient, the second vibratory member being configured for emitting a vibratory signal of variable intensity which can be felt by the patient.

13. The hearing aid apparatus of claim 11 further comprising a sound Intensity controller for comparing the relative volume of sound received on the patient's first side with the volume of sound received on the patient's second side, and generating a signal to each of the first and second vibratory members for causing the first and second vibratory members to emit vibratory signals that correlate in intensity to the respective volumes of sound received on the patient's first and second side.

14. The hearing aid apparatus of claim 12 wherein the indicia member comprises a first light producing member positioned on the same side of the patient as the first ear, the light producing member being configured for emitting a first light signal of variable intensity that can be seen by the patient, and a second light producing member positioned on the same side of the patient as the second ear, the second light providing member being configured for emitting a second light signal of variable intensity that can be seen by the patient.

* * * * *